United States Patent [19]

Richter, Sr.

[11] Patent Number: 4,949,059

[45] Date of Patent: Aug. 14, 1990

[54] FLANGE ENGAGEMENT OF CAPTIVE TUBE BY ENCLOSURE WALL IN ELECTROMAGNETIC CIRCUIT BREAKERS MOUNTED ON A BASE

[75] Inventor: Konrad J. Richter, Sr., Lawrenceville, N.J.

[73] Assignee: Heinemann Electric Company, Lawrenceville, N.J.

[21] Appl. No.: 313,955

[22] Filed: Feb. 22, 1989

[51] Int. Cl.[5] ..... H01H 9/02

[52] U.S. Cl. ..... 335/202; 200/293

[58] Field of Search ..... 335/202, 6; 200/193, 200/5, 203, 208

[56] References Cited

U.S. PATENT DOCUMENTS 4,752,755 6/1988 Nakano et al. ..... 335/202

*Primary Examiner*—Leo P. Picard
*Assistant Examiner*—Lincoln Donavan
*Attorney, Agent, or Firm*—Dann, Dorfman, Herrell and Skillman

[57] ABSTRACT

An electromagnetic circuit breaker in which the mechanism for the circuit breaker is supported on the frame, in turn, supported on a base. Cooperative with the base is an insulating housing enclosure which is moved over the mechanism and into a fixed latching engagement with the base using detents or other indexing devices. The electromagnetic coil for the breaker is supported on a bobbin, in turn, supported on a platform on the frame. A non-magnetic tube contains the magnetic core which is biased away from the pole piece closing the end of the tube. At the pole piece end of the tube a radially extending flange of the tube engages the other flange of the bobbin and supports the tube to extend through the hollow core of the bobbin and the coil wrapped thereon. Shoulders are provided on the sidewalls of the housing enclosure in position such that as the housing enclosure is brought into latched engagement with the base, the shoulder will engage the flange and press it against the bobbin, thereby clamping the tube and the coil on its bobbin in fixed position relative to the frame. In preferred embodiments flange extensions from diametrically opposite sides of the flange are accommodated by channels in the sidewalls guiding the extensions into contact with the shoulders.

4 Claims, 2 Drawing Sheets

FLANGE ENGAGEMENT OF CAPTIVE TUBE BY ENCLOSURE WALL IN ELECTROMAGNETIC CIRCUIT BREAKERS MOUNTED ON A BASE

The present invention relates to electromagnetic circuit breakers which employ a movable core, usually immersed in a liquid in a non-magnetic tube placed within the actuating coil of the circuit breaker. More specifically the present invention relates to means for clamping a flange on the tube in position relative to the frame supporting the armature and other elements of the mechanical linkage system which allows actuation of the circuit breaker to open its contacts.

BACKGROUND OF THE INVENTION

For many years it has been common practice to use a movable magnetic core within the actuating electromagnetic coil of a circuit breaker. Commonly the movable core has been a cylindrical structure supported and guided in a non-magnetic tube spring and/or gravity urged away from the pole piece, and rather commonly immersed in a damping fluid to delay the movement of the core toward the pole piece. When the breaker contacts are closed, the current flows through the coil and begins to urge the core toward the pole piece. However, only when the current reaches a predetermined overload level is the force strong enough to urge the core to the pole piece and, in turn, attract the movable armature of the breaker toward the pole piece, thereby tripping the breaker and releasing the contacts.

In the past, in order to positively hold the tube supporting the core in position it has been necessary to employ means mechanically connecting the tube to the coil and the frame, thus necessitating fabrication of a sub-assembly which is different for each type of coil and for each combination of other components which comprise the various sub-assemblies. Then it is necessary to maintain a sub-assembly inventory of many types of sub-assemblies ready for use in various types of breakers. Maintaining such an inventory is costly and separately assembling the sub-assemblies and the final breaker assembly is inefficient. At the present time, any changes to parts requires costly off the line salvage disassembly with losses of valuable parts.

THE NATURE OF THE PRESENT INVENTION

The present invention provides a means for clamping the tube holding the magnetic core in place in the course of final assembly of the breaker so that manufacture and inventory of sub-assemblies is not necessary. The construction provides an improved circuit breaker time delay tube retaining means that allows for assembly line manufacturing flexibility and eliminates the need for permanent manufacture of a special subassembly holding the tube in place by welding, soldering or like techniques which normally would require separate preassembly of parts or the manufacture of a special subassembly. In addition the new clamping technique allows for replacement rather than discarding of parts that deviate from the specification during testing and/or expensive salvage of other parts. The present technique also provides a mechanically secure means of clamping a time delay tube to the circuit breaker main frame without the use of a semi-permanent retaining ring or soft solder. Rather than requiring subassembly of parts, the whole assembly is completed on the main assembly line. The present invention allows for immediate production line changes using various tubes and coils and eliminates delay in building of product orders to a variety of specifications for delivery to customers. The advantages of the present invention are accomplished without loss of precise location of the tube pole piece to the tripping mechanism and positive clamping of the parts in position.

In accordance with the present invention the magnetic core containing tube is provided with a radial flange which allows it to be supported atop the coil bobbin which, in turn, is supported at its opposite end on a flange of the frame. Alternatively the flange of the tube may be directly supported on the frame. In either event, the present invention is directed to clamping the flange of the tube against a supporting surface using a clamping member which engages at least the tube flange and a portion of the breaker housing designed for that purpose and so arranged that it will cause the clamp to clamp directly down on the flange of the tube and hold it positively relative to the frame directly or through the coil bobbin.

More specifically, the present invention relates to an electromagnetic circuit breaker having a pair of breaker switch contacts electrically connected in series with a magnetic coil in which an insulating base supports a frame. The frame, in turn, supports at least a linkage for opening and closing the switch contacts having manual actuation means to open and close the switch contacts and a movable armature attractable to a pole piece for opening the switch contacts on overload. The pole piece terminates a non-magnetic tube containing and guiding a magnetic core. The non-magnetic tube is located within a bobbin supporting the magnetic coil and has a radially extending tube flange at the pole piece end. An insulating housing enclosure for enclosing the structure is supported on the base, the enclosure being connectable to the base so as to provide a unitary housing. The tube flange is engaged by shoulders on the respective opposed sidewalls of the interior of the enclosure as the enclosure is passed over the breaker structure so that just prior to connection with the base, pressure is applied to urge the tube flange against its supporting surface. The result is to clamp in place the flange and all structure between the flange and the frame.

THE DRAWINGS

SPECIFIC DESCRIPTION OF THE DRAWINGS

Figure 1:
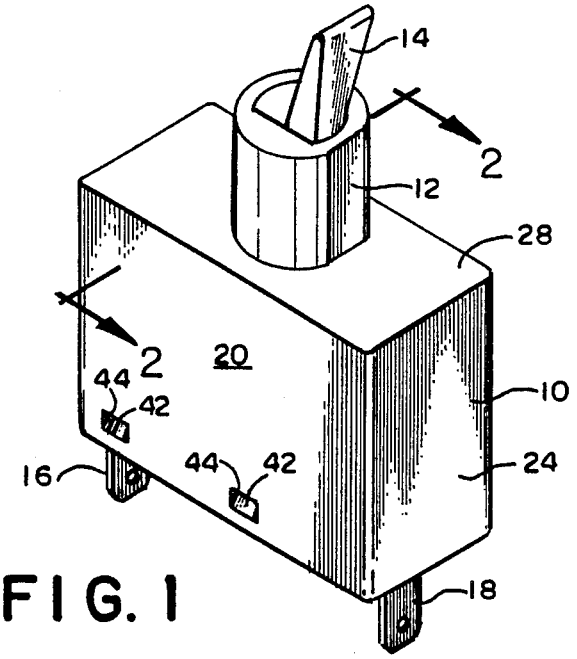
FIG. 1 is a perspective view of a circuit breaker employing the present invention.
Figure 2:
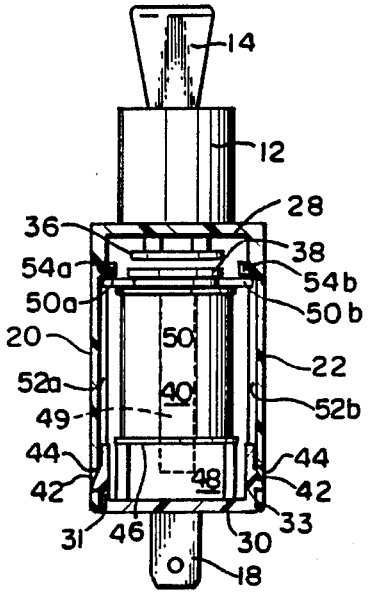
FIG. 2 is a sectional view taken along line 2—2 showing the structure supporting the coil.
Figure 3:
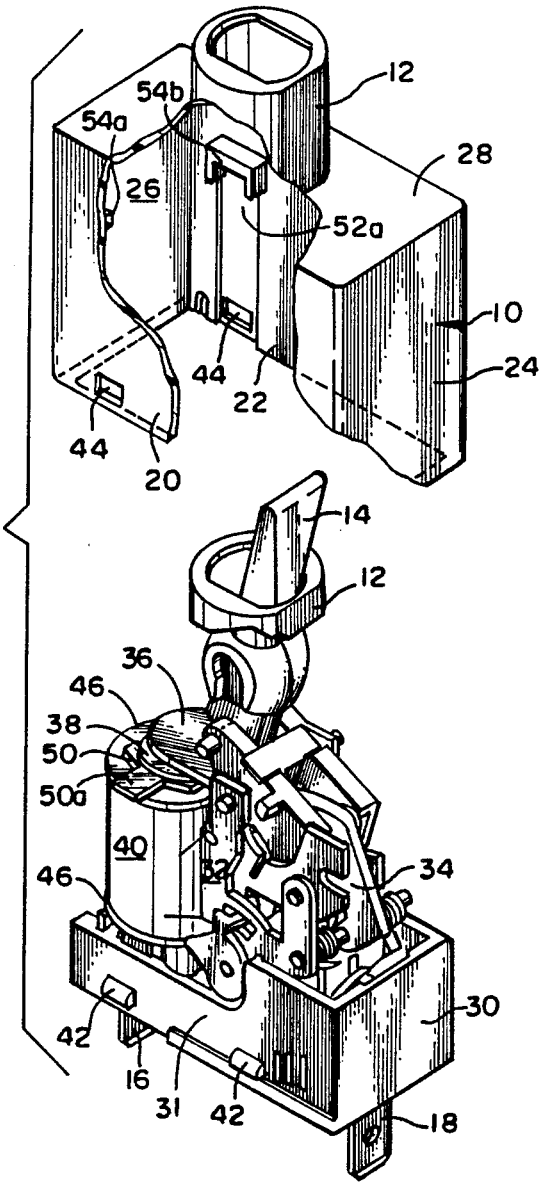
FIG. 3 is an exploded view showing the cover removed from the breaker structure with part of the cover broken away to show some of the interior's construction.

Referring to FIG. 1, the breaker illustrated is a conventional rectangular breaker having an enclosure housing 10 for the breaker mechanism. The housing 10 provides an opening in the top edge wall 28 through a neck 12, through which an actuating handle 14 to open and close the contacts of the breaker extends. Extending from the opposite edge wall of the breaker are terminals 16 and 18 by which the electrical circuit of the breaker including the magnetic coil 40 and the breaker contacts (not shown) may be connected into the circuit in which it is to function. As seen in FIGS. 2 and 3 the cover in this case is a rectangular box cover 10 which has two broad sidewalls 20 and 22, two edge end walls 24 and 26 and a top wall 28. The cover has been broken away to show a part of the structure of the invention which will be described below. Cooperating with the cover is a base 30 of molded resinous material like the sidewalls. The base provides support for the terminals 16 and 18 and the terminals extend into the breaker housing through the wall provided by the molded base. The molded base also supports a sheet metal frame 32 which, in turn, supports a switch actuating linkage mechanism 34 in such a way that the parts can move as desired relative to one another, the specific nature of which is not relevant to the present invention. The switch lever 14 is connected to the linkage mechanism and acts to open and close the switch contacts, a movable contact supporting arm being actuable by the linkage mechanism. Another part of the linkage mechanism is the pivotable armature 36 which is drawn into the pole piece 38 when overload current passes through coil 40 to release the linkage mechanism and open contacts. The frame is mounted and firmly supported on the base 30. The housing 10 is fixed to the base by detents 42 located in this particular version on opposite sides of the long edges 31, 33 (FIG. 2) of the base. The detents 42 are cooperable with receiving openings 44 in the housing walls 20 and 22. Thus frame, base and housing are firmly fixed relative to one another as though they were part of the same structure.

The bobbin 46 for the coil 40 is supported on a pedestal 48 on the base. In other embodiments the bobbin could be supported on a platform extension of the frame 32. Whatever the support, provision must be made to accommodate for the magnetic core containing tube 49 (indicated in dashed lines in FIG. 2) which is provided on the axis of the coil 40 to extend below the coil 40 into the pedestal 48. This tube 49 is made of non-magnetic material and guides the magnetic core element. The core element is gravity and spring biased downward and away from the flange 50 at the open end of the tube. When open, the end of the tube permits insertion of the core, the biasing spring and any viscous fluid that may be employed for damping purposes. Then the tube is closed with the pole piece 38, in such a way as to provide a sealed structure holding in the core, fluid and the spring. Flange 50 is provided with flange extensions **50*a* and 50*b* which extend toward the sidewalls 20 and 22 of the housing 10 and into slots 52*a* and 52*b* in the sidewall. At the top ends of the slots are stops 54*a* and 54*b* which are positioned to engage and press against the extensions 50*a* and 50*b* when the detents 42 are engaged in the slots 44 in the cover. This pressure causes the flange 50 to bear down on the top of the bobbin 46 and hold it against the pedestal 48, thus firmly holding the tube 49 and in the coil 40** to the base fixed relative to the support frame. This simple assembly can be accomplished on an assembly line for assembling the whole breaker without having to produce a prior sub-assembly of bobbin, coil and tube by soldering or mechanically connecting the parts.

It will be apparent to those skilled in the art that variations on the structure described can be made to accomplish essentially the same purpose. All such variations within the scope of the claims are intended to be within the scope and the spirit of the present invention.

I claim:

1. An electromagnetic circuit breaker having a pair of breaker switch contacts electrically connected in series with a magnetic coil comprising an insulating base supporting a frame which, in turn, supports at least a linkage for opening and closing the switch contacts and having manual actuation means to open and close the switch contacts and a movable armature attractable to a pole piece for opening the switch contacts on overload, the pole piece terminating a non-magnetic tube containing and guiding a magnetic core, the non-magnetic tube being located within a bobbin supporting the magnetic coil and having a radially extending tube flange at the pole piece end, and an insulating housing enclosure for enclosing the structure supported on the base, the enclosure being connectable to the base so as to provide a unitary housing, the tube flange being engaged by shoulders on the respective opposed sidewalls of the interior of the enclosure as the enclosure is passed over the breaker structure so that just prior to connection with the base, pressure is applied to urge the tube flange against its supporting surface and clamp in place the flange and all structure between the flange and the frame.

2. The electromagnetic circuit breaker of claim 1 in which the supporting bobbin for the coil has one flange supported on a platform provided by the frame and supports the flange of the non-magnetic tube on its other flange thereby applying pressure through the shoulders and the sidewalls of the enclosure and the flange will clamp the flange and the bobbin, and hence the supported coil, to the frame.

3. The electromagnetic circuit breaker of claim 2 in which the flange is provided with extensions and diametrical positions arranged to engage the shoulder and the housing is provided with channels to accommodate and guide the extensions until they engage the shoulders.

4. The electromagnetic circuit breaker of claim 3 in which the shoulders on the housing are provided by framing members extending out from the sidewalls around the ends of the channels to more securely engage the extensions.

* * * * *